US005396823A

United States Patent [19]

Hoshino

[11] Patent Number: 5,396,823

[45] Date of Patent: Mar. 14, 1995

[54] RIB REINFORCED, INTEGRAL GUITAR BELLY

[75] Inventor: Yoshiki Hoshino, Aichi, Japan

[73] Assignee: Hoshino Gakki Co., Ltd., Nagoya, Japan

[21] Appl. No.: 230,647

[22] Filed: Apr. 21, 1994

[30] Foreign Application Priority Data

Apr. 22, 1993 [JP] Japan ..... 5-026804 U

[51] Int. Cl.[6] ..... G10D 3/00

[52] U.S. Cl. ..... 84/291; 84/452 P

[58] Field of Search ..... 84/267, 275, 291, 452 P

[56] References Cited

U.S. PATENT DOCUMENTS 4,213,370 7/1980 Jones ..... 84/291
4,429,608 2/1984 Kaman et al. ..... 84/291
4,836,076 6/1989 Bernier ..... 84/291 X

*Primary Examiner*—Michael L. Gellner
*Assistant Examiner*—Patrick Stanzione
*Attorney, Agent, or Firm*—Ostrolenk, Faber, Gerb & Soffen

[57] ABSTRACT

A guitar belly for a guitar body including a rear or reverse plate and a side plate around and standing up from the rear plate, which are integrally formed of the same plastic material. A separate cover plate is attached over the edge of the side plate to close the guitar belly. Reinforcing ribs are integrally formed of the same material as and along with the reverse plate. These include two or three longitudinal ribs extending from at or near the top front end of the reverse plate to the bottom end thereof, two horizontal ribs, one at the narrower width part and one at the greater width part of the belly, and two oblique ribs, each extending obliquely from the center of the belly and toward the one end of the belly and respectively outward from the center of the belly in opposite directions. Some or all of the ribs also extend up the side wall of the guitar belly. The ribs cooperate to prevent distortion of the belly due to string tension or other causes including playing the guitar. Each of the ribs may be a single rib or a double rib.

15 Claims, 6 Drawing Sheets

FIG. 4
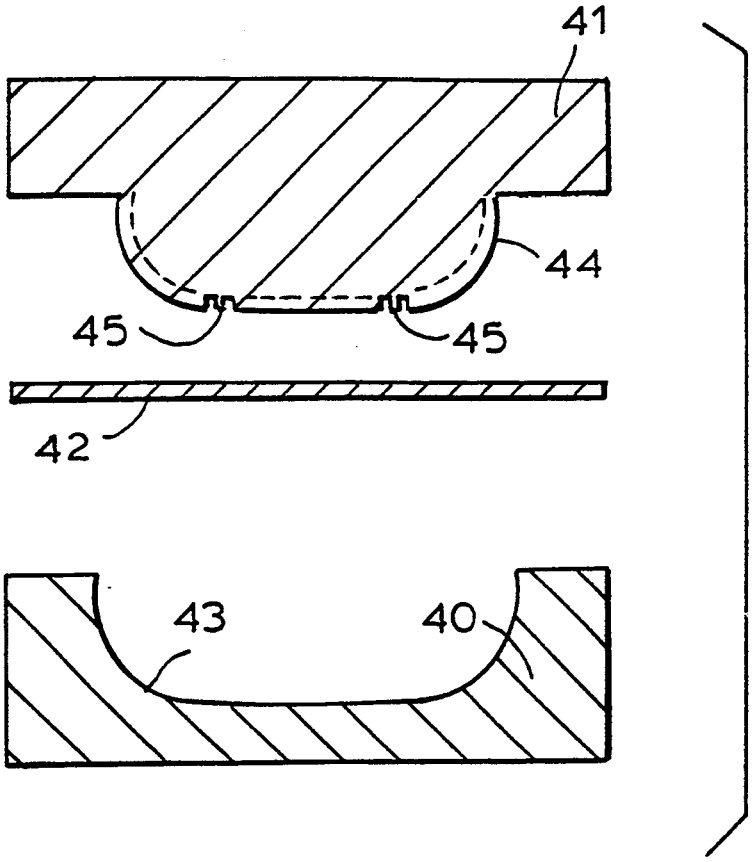
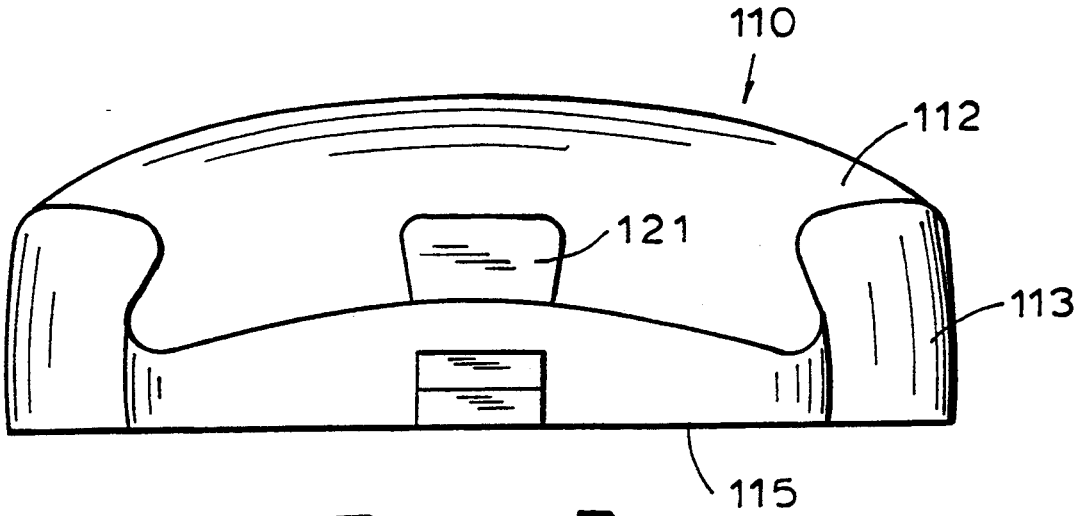
FIG. 7

RIB REINFORCED, INTEGRAL GUITAR BELLY

BACKGROUND OF THE INVENTION

The invention relates to a guitar belly structure having the resonance box of an acoustic guitar, in particular.

The belly of a guitar having a resonance box, such as an acoustic guitar but including an electric guitar, is ordinarily produced by preparing the reverse plate or rear plate and the side plates of the guitar belly using naturally dried wooden plates and joining the reverse and side plates together. In this kind of wooden guitar belly, however, natural drying for a long period of time is necessary in order to eliminate internal stress and strain in the natural wood. Unsatisfactory natural drying will cause the wooden plates of the guitar belly to deform due to internal stresses after the guitar has been manufactured, producing small deformations in the guitar belly, and disturbing the tension of the guitar strings. Furthermore, natural drying requires time and expense, and cost is incurred for storage of the guitar.

Preparing a guitar belly made of wood according to prior art, moreover, requires the separate manufacturing steps of preparing a reverse plate and a side plate and then gluing these plates together to form an integral body.

Recently, attempts have been made to assemble a guitar belly comprising the reverse plate and the side plates as one body using plastics reinforced by glass fiber, etc. A guitar belly made of plastic as its main ingredient avoids the need for and time spent in the natural drying process which has been required for the wooden plates, and there is no contraction due to internal stresses. Since both the reverse plate and the side plates can be formed continually as one body by means of press forming, furthermore, this avoids the manufacturing step of gluing together the reverse plate and the side plates.

In the known guitar belly whose main ingredient is plastic, however, there has been a tendency for the belly to deform over time because of the tensile force of the strings at the time when they are put to use, simply because the reverse plate and the side plates are formed integrally.

SUMMARY OF THE INVENTION

An object of the invention is to overcome the above described problems in a guitar belly wherein the reverse plate and the side plate are formed continually and integrally of a plastic. Any deformation of the guitar belly due to the passage of time can be prevented by the tensile force of the strings at the time when they are put to use.

The guitar belly of the invention includes a body comprised of a reverse or rear plate and at least one side plate which stands up from the reverse plate toward the front of the guitar. The reverse and side plates are formed continually and integrally of plastic as the main ingredient. A longitudinal rib is formed on the inner side of the reverse plate of the belly and extends in the longitudinal direction from the top or front or peghead end of the reverse plate to the bottom or rear or bridge end thereof. At least one horizontal rib is also formed on the inner side of the reverse plate of the belly and extends in the width direction of the belly and up the side plate at both sides of the belly. At least one oblique rib extends from the center of the reverse plate of the belly toward the front region at one side. A respective oblique rib may be formed at both sides of the center of the belly. The oblique rib may extend up the side plate or terminate before extending up the side plate. All of the ribs are integrally formed with and are of the same material of which the belly is formed. In one embodiment, each rib is a single rib in width. In another embodiment, each rib is comprised of two closely spaced parallel ribs.

Other objects and features of the invention are explained below with reference to the attached drawings.

BRIEF DESCRIPTION OF THE DRAWINGS

FIG. 4 is a cross section showing the manufacture of a guitar belly of this invention;

FIG. 7 is a front end view of the exterior of either embodiment, showing the curved profile of the guitar belly.

DESCRIPTION OF THE PREFERRED EMBODIMENT

Figure 1:
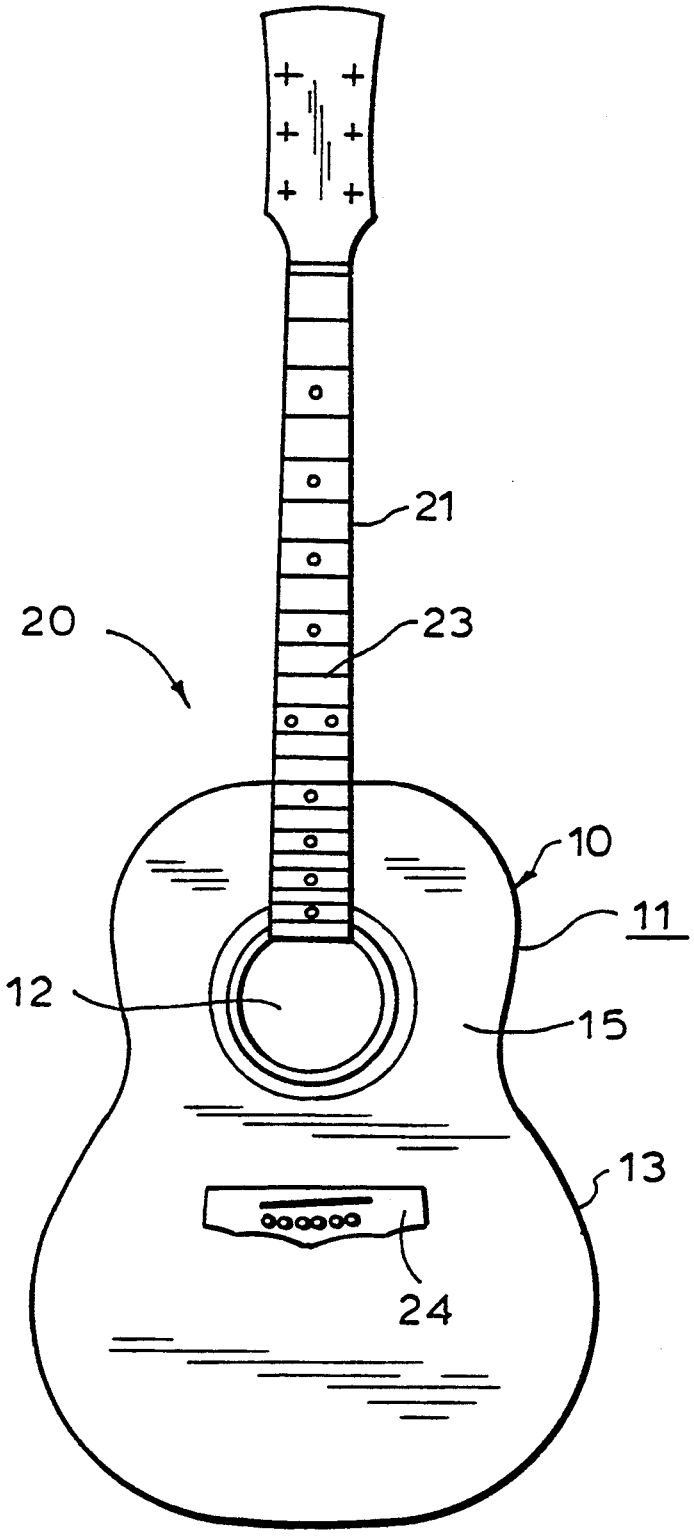
FIG. 1 is a front view of a guitar including a first embodiment of a guitar belly according to the invention.
Figure 2:
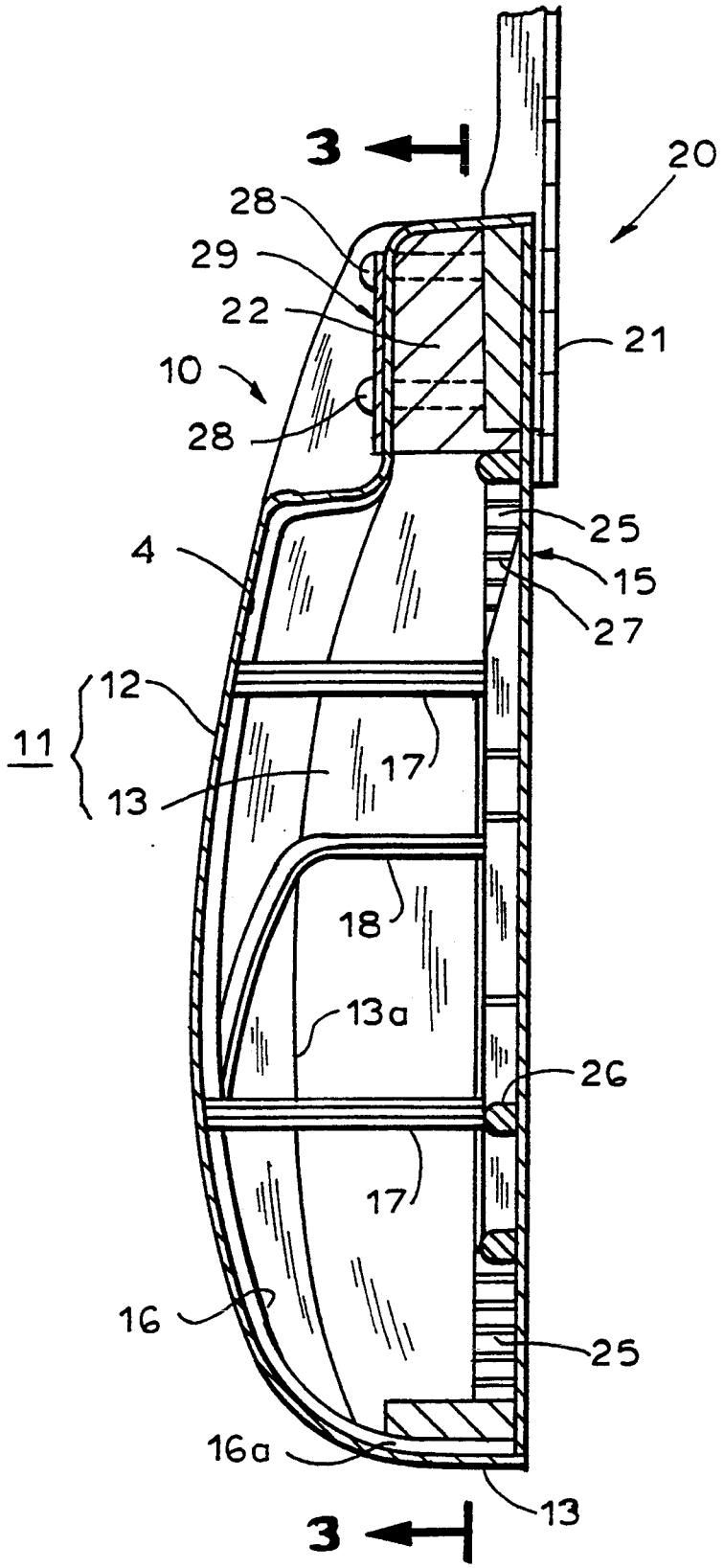
FIG. 2 is a longitudinal cross-sectional view of the belly.

As shown in FIGS. 1 and 2, the guitar belly 10 according to the first embodiment of the invention comprises a main belly body 11 including a reverse plate or rear plate 12 and a side plate 13 which stands up from the reverse plate. The front side of the belly body is open and is covered over by a front plate 15. These elements constitute a resonance box of an ordinary acoustic guitar 20. The guitar includes a neck 21 with frets 23 and includes a bridge 24.

The main belly body 11, 12, 13 is made from glass fiber reinforced plastic as its main ingredient. The reverse plate 12 and side plate 13 are made continually and integrally with each other, forming a prescribed bellied shape. The guitar neck 21 is installed at one end of the main belly body 11 through a neck holding part 22 by fixing bolts 28. A pedestal 29 made of a metal sheet is held by the bolts 28 on the part 22.

The reverse plate 12 constitutes the back part of the guitar belly 10. It has a planar surface, in addition to the curved surface, in some cases.

The side plate 13 constitutes the side of the guitar belly 10. The side plate 13 meets the reverse plate generally at an edge 13*a*, as seen in FIGS. 2 and 7. The side plate stands up from the reverse plate to its top edge. A lining 25 on the inner surface of the top edge of the side plate is provided for installation of the front plate 15. The lining 25 comprises a wooden plate which has a suitable width and a length which is approximately the same as the inner peripheral length of the side plate. A large number of cuts 27 are provided at prescribed intervals on the lining. This enables the lining 25 to be installed in a curved pathway along the curved shape of the inner peripheral surface of the side plate 13. It is also possible to install the wooden pieces having a suitable width continually along the upper edge of the side plate 13.

The front or surface plate 15 comprises a separate, preferably wooden plate which is fixed on the upper surface of the lining 25. A bracing or prop stick 26 reinforces the surface plate 15.

Figure 3:
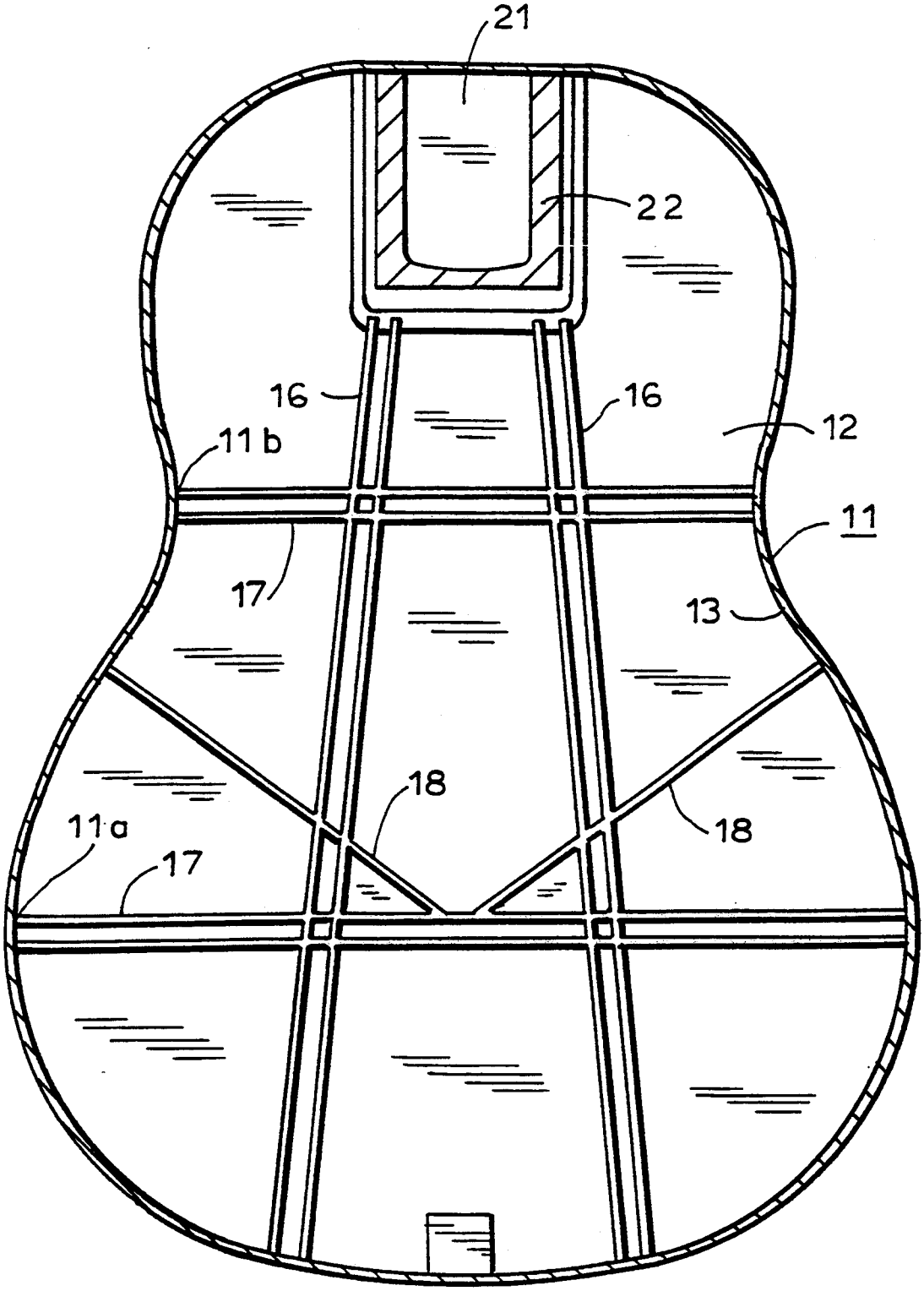
FIG. 3 is a plan, cross-sectional view of the belly along line 3—3 in FIG. 2.

FIGS. 2 and 3 show two longitudinal ribs 16, two horizontal or cross ribs 17 and two oblique ribs 18 all formed on the inner bellied surface 14 of, extending up the side wall of and formed integrally with the main belly body 11.

The longitudinal ribs 16 each extend in the longitudinal direction, i.e. top to bottom, or front to rear, or peg head end to bridge end, of the guitar belly body 11. The ribs 16 continue up the rear end part of the side wall at 16*a*. The longitudinal ribs reinforce the guitar belly in the front-to-back direction and prevent curving or deformation of the guitar belly around an axis extending in the horizontal direction, thereby preventing deformation of the belly body 11 in the front-to-back direction which might be caused by the tensile force exerted by the strings. As seen in FIG. 3, the longitudinal ribs 16 are placed symmetrically on opposite sides of and are near to the center of the belly body 11. In this embodiment, they are of lengths such that they extend from the neck holding part 22 to the upper edge of the side plate part 12 on the opposite side away from the part 22 and then up the side plate. In the first embodiment, each rib 16 comprises a respective pair of close together ribs 16, with one pair located on each side of the guitar neck 21.

Each horizontal rib 17 extends in the width direction of the belly body 11 and reinforces the guitar belly around an axis extending in the horizontal direction. A horizontal rib is provided at the part of the belly body 11 having the largest width 11*a* and another horizontal rib is provided at the part of the body 11 having the smallest width 11*b*. Both ribs extend across the reverse plate and up the side plate at both sides of the guitar belly. In the first embodiment, each rib 17 comprises a respective pair of close together ribs 17 provided at each horizontal rib location. The horizontal ribs 17 extend continually from the underside of the lining 25 on the one side plate 13 up the side plate,+ across the reverse plate, up the other side plate to the underside of the lining 25 in the other side plate 13.

Each oblique rib 18 extends obliquely from the central part of the reverse plate 12 toward the front or top of the side plate 13, in the direction of the neck and toward a respective side of the belly. In this example, the ribs 18 are formed integrally with and extend approximately from the center of the horizontal rib 17 which is provided at the largest width location 11 of the main belly body and somewhat toward the front of the side plates 13 and on both of the right and the left sides of the reverse plate 12. As seen in FIG. 2, after the oblique ribs 18 meet the side plate 13 at edge 13*a*, they continue straight up the respective side plate 13. In the first embodiment, each oblique rib 18 comprises a respective pair of close together ribs, as shown in FIG. 3. The oblique ribs are for preventing deformation of the guitar belly 10 in a distorted direction.

The thickness and height of the ribs 16, 17 and 18 are selected in accordance with the size and shape of the guitar belly. In this example, their thickness is set at approximately two millimeters and their height at approximately four millimeters.

Each of the ribs 16, 17 and 18 is formed integrally with and of the same a plastic as the main belly part 11. The ribs together are capable of preventing deformation or warping of the guitar belly 10 in all directions. In addition, the quantity and locations of the ribs 16, 17 and 18 can be suitably determined in consideration of the size of the guitar belly, the thickness of the belly body and the physical properties of the plastic that is used.

Figure 5:
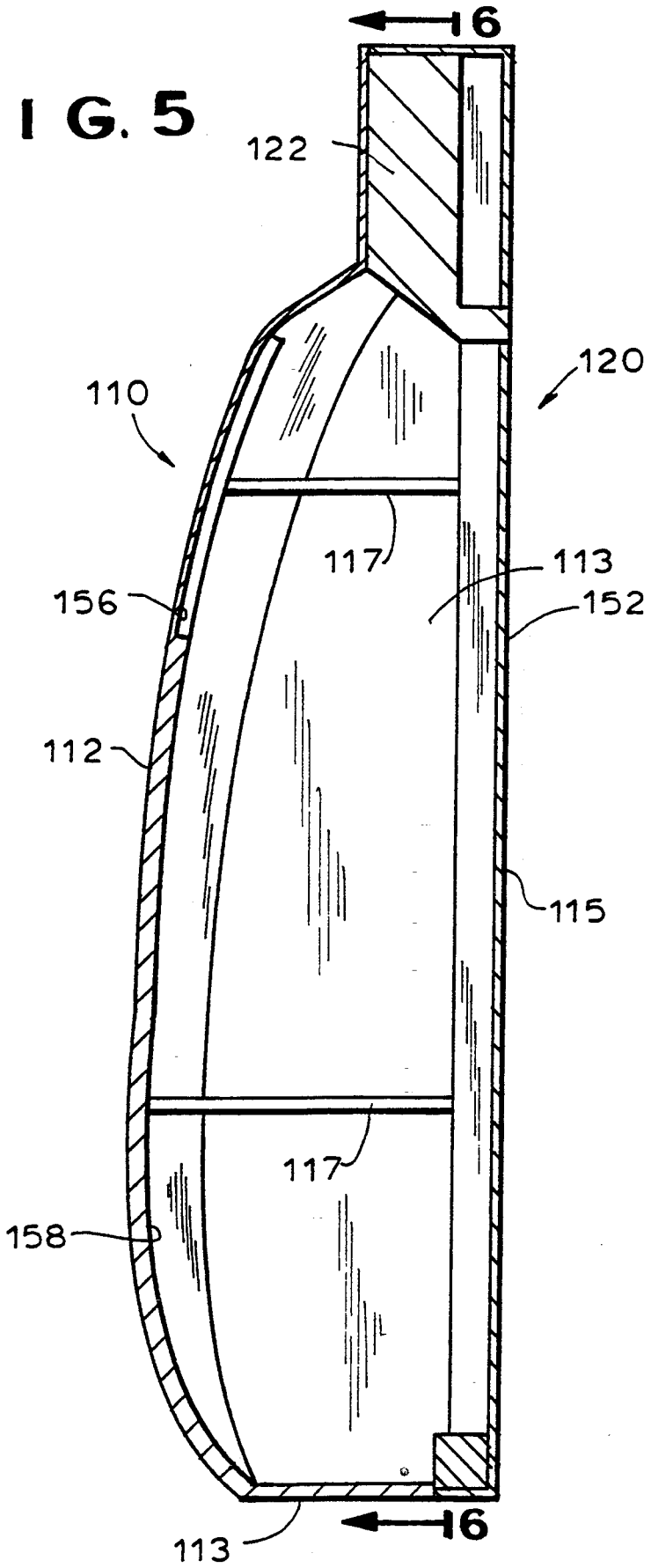
FIG. 5 is a longitudinal cross-sectional view of a second embodiment.
Figure 6:
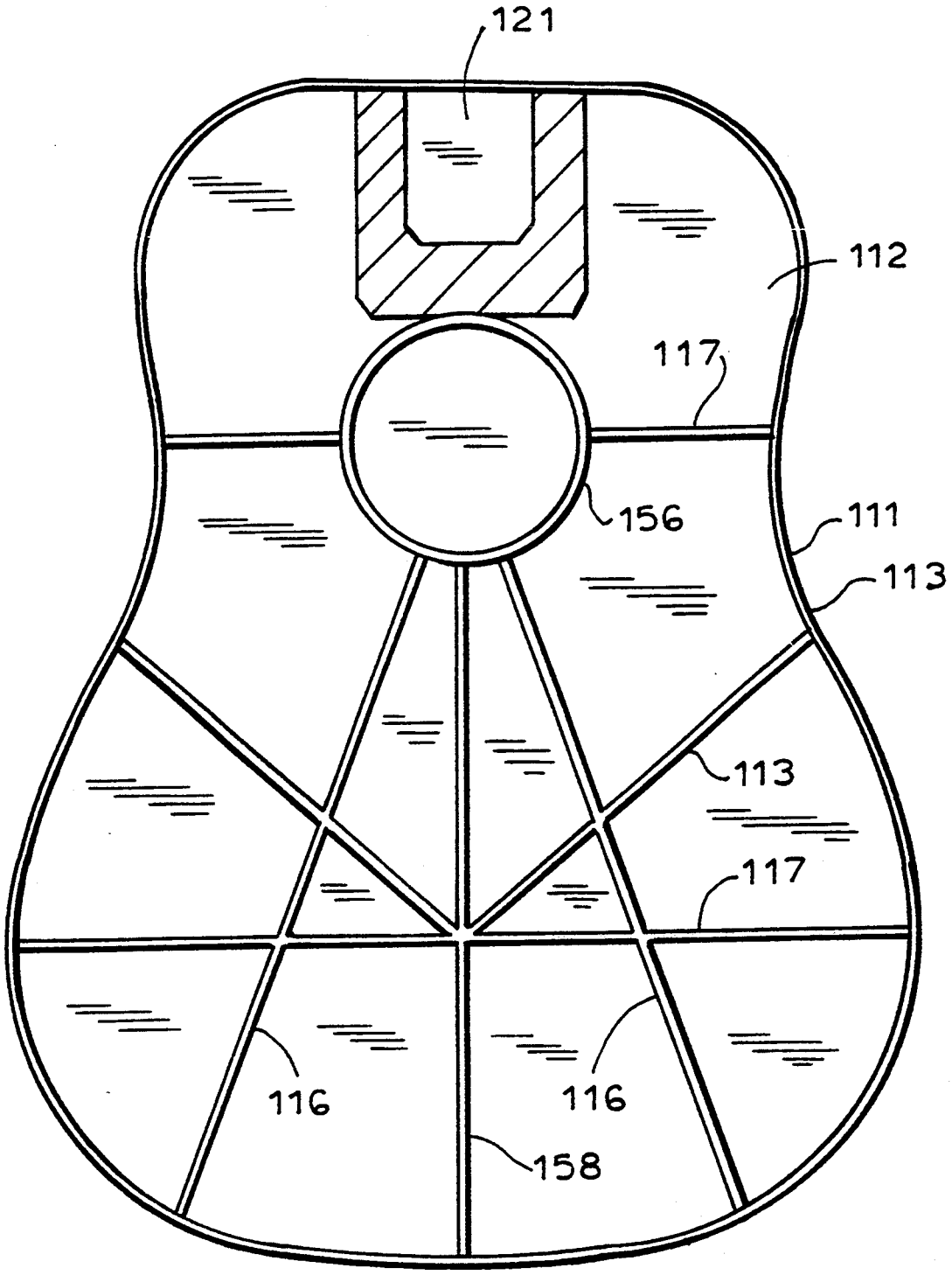
FIG. 6 is a plan, cross section of the belly along line 6—6 in FIG. 5.

The second embodiment shown in FIGS. 5 and 6 differs from the first embodiment in several respects, although it is provided with sets of ribs extending in generally the same directions as in the first embodiment. Each rib in FIGS. 5 and 6 is a single rib integral with the guitar belly, rather than a respective closely spaced pair of parallel ribs as in FIG. 3. The ribs and other elements of the guitar in the second embodiment are generally of the same kind and in the same locations and perform the same functions as in the first embodiment, and that detailed description is not repeated. Elements in FIGS. 5 and 6 which correspond to those in FIGS. 1–3 have the same reference numbers raised by 100. The significant different features are now described.

The front plate 115 has an opening 152 through it opening into the guitar belly. As seen in FIG. 6, there is a circular rib 156 molded into and upstanding from the rear surface 112 of the belly body generally below the opening 152 in the front plate 115.

There are two longitudinal ribs 116, from the rear or bridge end to the front or neck end. Those ribs also extend up the side plate 113 at the rear end of the belly. Their front end is at the circle rib 156, rather than extending forward to nearly the neck, as in the embodiment in FIG. 3 The ribs 116 generally converge toward each other from the rear to the front ends of the reverse plate. There is an additional longitudinal rib 158 that extends forward along the center of the rear surface of the belly, between the ribs 116. It also extends up the side plate 113 at the rear, and it terminates at the rib 156 at its front end.

There are lateral or horizontal ribs 117 placed where the ribs 17 are placed in FIGS. 2 and 3 and also extending up the side plate at both lateral sides of the belly body.

There are oblique ribs 118, which are generally at the same location and orientation as the ribs 18 in FIG. 3. However, as shown in FIG. 5, the ribs 118 terminate at the edge of the belly body and do not extend up the side plate 113, unlike the corresponding ribs 18 in FIG. 2.

All of the ribs 116, 117, 118, 156 are single thick ribs, not the double ribs of the first embodiment.

The guitar belly 10 has a prescribed belly shape formed, for example, by thermal pressing. FIG. 4 shows one example of a forming mold 40 and a cooperating pressing mold 41. The forming mold 40 includes a forming surface 43 for determining the external shape of the reverse and side plates of the guitar belly. A forming surface 44 for defining the inner shape of the reverse and side plates of the guitar belly is provided on the pressing mold 41. There are also concaves 45 in the forming surface 44 for forming the longitudinal ribs 16, horizontal ribs 17 and oblique ribs 18.

A sheet material 42, such as a plastic reinforced with fibers, etc., is arranged between the pressing mold 40 and the forming mold 41 and it is softened by the heat. As the pressing mold 41 and the forming mold 40 are compressed against the sheet material 42, the sheet material 42 is deformed into the prescribed shape of a guitar belly possessing the ribs 16, 17 and 18 all in one integral body.

A guitar belly of the invention includes a belly part which is made entirely of plastic as a main ingredient, continually and integrally, with the longitudinal ribs, horizontal ribs and oblique ribs being formed integrally on its inner surface and of the same plastic. In such a guitar belly made of plastic, the possible warping or bending of the guitar body by the tensile force of the strings during the course of usage can be minimized.

Further, the time required for manufacture of the guitar body can be shortened, so that its production can be easily carried out, as compared with the wooden product according to the prior art.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A guitar belly for a guitar comprising a reverse plate and at least one side plate which is formed continuously and integrally with the reverse plate; the reverse plate and the side plate having a main ingredient of plastic;

the reverse plate having an inner side toward the interior of the belly, longitudinal ends and opposite sides across the width;

a longitudinal rib extending in the longitudinal direction on the inner side of the reverse plate;

a horizontal rib extending in the width direction of the belly on the inner side of the reverse plate; and an oblique rib extending obliquely generally from the center of the reverse plate toward one of the longitudinal ends of the reverse plate on the inner side of the reverse plate;

the ribs being integrally formed of the same material of and with the guitar belly.

2. The guitar belly of claim 1, wherein the side plate has an edge away from the reverse plate; the belly further comprising a front plate over the edge of the side plate.

3. The guitar belly of claim 2, further comprising a guitar neck attached at the one longitudinal end of the guitar belly and extending away therefrom.

4. The guitar belly of claim 1, wherein the reverse plate has a center across the width and there is a respective longitudinal rib at each side of the center spaced slightly out from the center;

there are at least two of the horizontal ribs at locations spaced apart from each other along the longitudinal direction of the guitar belly; and there are two of the oblique ribs, each extending generally from the center of the reverse plate and each extending outward in the respective opposite direction and each extending toward the one longitudinal end of the belly.

5. The guitar belly of claim 4, wherein the belly has a greater width part and a narrower width part and the belly has a respective horizontal rib in each of the greater and the narrower width parts of the guitar belly.

6. The guitar belly of claim 4, wherein each of the longitudinal, horizontal and oblique ribs comprises a respective pair of close together ribs.

7. The guitar belly of claim 4, where the reverse plate is bellied outwardly and the ribs follow the bellied shape of the reverse plate.

8. The guitar belly of claim 4, wherein the side plate has an edge away from the reverse plate; the belly further comprising a front plate over the edge of the side plate.

9. The guitar belly of claim 8, further comprising a guitar neck attached at the one longitudinal end of the guitar belly and extending away therefrom.

10. The guitar belly of claim 9, where the reverse plate is bellied outwardly and the ribs follow the bellied shape of the reverse plate.

11. The guitar belly of claim 4, wherein each of the longitudinal, horizontal and oblique ribs is a single respective rib.

12. The guitar belly of claim 4, further comprising a circular rib upstanding from the reverse plate generally toward the one longitudinal end of the body and the longitudinal ribs extending to and ending at the circular rib.

13. The guitar belly of claim 12, wherein there are three of the longitudinal ribs, two generally converging toward each other from the second to the one longitudinal end of the body and the third rib between the other two ribs.

14. The guitar belly of claim 4, wherein at least some of the ribs extend from the reverse plate onto and up the side plate.

15. The guitar belly of claim 4, wherein the longitudinal ribs converge toward each other from the second to the one longitudinal end of the body.

* * * * *